US010986905B1

(12) United States Patent
Janczewski

(10) Patent No.: US 10,986,905 B1
(45) Date of Patent: Apr. 27, 2021

(54) UMBRELLA CASE

(71) Applicant: Zaida Janczewski, Bronx, NY (US)

(72) Inventor: Zaida Janczewski, Bronx, NY (US)

( * ) Notice: Subject to any disclaimer, the term of this patent is extended or adjusted under 35 U.S.C. 154(b) by 0 days.

(21) Appl. No.: 16/741,855

(22) Filed: Jan. 14, 2020

(51) Int. Cl.
*A45B 25/24* (2006.01)
*A45B 25/28* (2006.01)

(52) U.S. Cl.
CPC ..... *A45B 25/24* (2013.01); *A45B 25/28* (2013.01)

(58) Field of Classification Search
CPC ..... A45B 25/24; A45B 25/28
See application file for complete search history.

(56) References Cited

U.S. PATENT DOCUMENTS 4,558,807 A * 12/1985 Jackson ..... A45B 25/24 224/251
5,111,835 A 5/1992 Lin
5,323,802 A 6/1994 Kiedrowski
5,465,743 A * 11/1995 Sheu ..... A45B 25/28 135/34.2
6,655,399 B1 * 12/2003 Williams ..... A45B 25/24 135/34.2
6,694,992 B2 2/2004 Gaskins
6,701,947 B1 3/2004 Ramos
9,322,593 B2 * 4/2016 Cheng ..... F26B 5/08
2006/0185702 A1 8/2006 Lewis
2006/0283905 A1 * 12/2006 Wu ..... A45B 25/24 224/576
2010/0200029 A1 8/2010 Fleming
2011/0154677 A1 * 6/2011 Pudalov ..... F26B 9/003 34/107
2013/0032184 A1 2/2013 Daly
2013/0048693 A1 * 2/2013 Chin ..... A45B 25/26 224/600
2016/0135557 A1 5/2016 Gorouvein

FOREIGN PATENT DOCUMENTS

WO WO-03047382 A1 * 6/2003 ..... A45B 25/18
WO 2013014642 1/2013
WO WO-2013032307 A2 * 3/2013 ..... A45B 25/24
WO WO-2017054206 A1 * 4/2017 ..... A45B 25/24

* cited by examiner

*Primary Examiner* — David R Dunn
*Assistant Examiner* — Danielle Jackson

(57) ABSTRACT

The umbrella case is configured for use with an umbrella. The umbrella case is a container that is sized to receive the umbrella. The umbrella case is a fluid impermeable structure. The umbrella case is a segregated structure. The umbrella case stores a wet umbrella in a first segregated space such that any water adhering to the umbrella drains off of the umbrella into a second segregated space such that the water is separated from the umbrella. The umbrella case comprises a collection structure, a storage structure, a superior structure, a connecting ring, and a lid structure. The collection structure removably attaches to the storage structure. The superior structure removably attaches to the storage structure. The connecting ring removably attaches the lid structure to the superior structure.

15 Claims, 4 Drawing Sheets

UMBRELLA CASE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of traveling articles including umbrellas, more specifically, a drip receptacle for a closed umbrella.

SUMMARY OF INVENTION

The umbrella case is configured for use with an umbrella. The umbrella case is a container that is sized to receive the umbrella. The umbrella case is a fluid impermeable structure. The umbrella case is a segregated structure. The umbrella case stores a wet umbrella in a first segregated space such that any water adhering to the umbrella drains off of the umbrella into a second segregated space such that the water is separated from the umbrella. The umbrella case comprises a collection structure, a storage structure, a superior structure, a connecting ring, and a lid structure. The collection structure removably attaches to the storage structure. The superior structure removably attaches to the storage structure. The connecting ring removably attaches the lid structure to the superior structure.

These together with additional objects, features and advantages of the umbrella case will be readily apparent to those of ordinary skill in the art upon reading the following detailed description of the presently preferred, but nonetheless illustrative, embodiments when taken in conjunction with the accompanying drawings.

In this respect, before explaining the current embodiments of the umbrella case in detail, it is to be understood that the umbrella case is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the umbrella case.

It is therefore important that the claims be regarded as including such equivalent construction insofar as they do not depart from the spirit and scope of the umbrella case. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
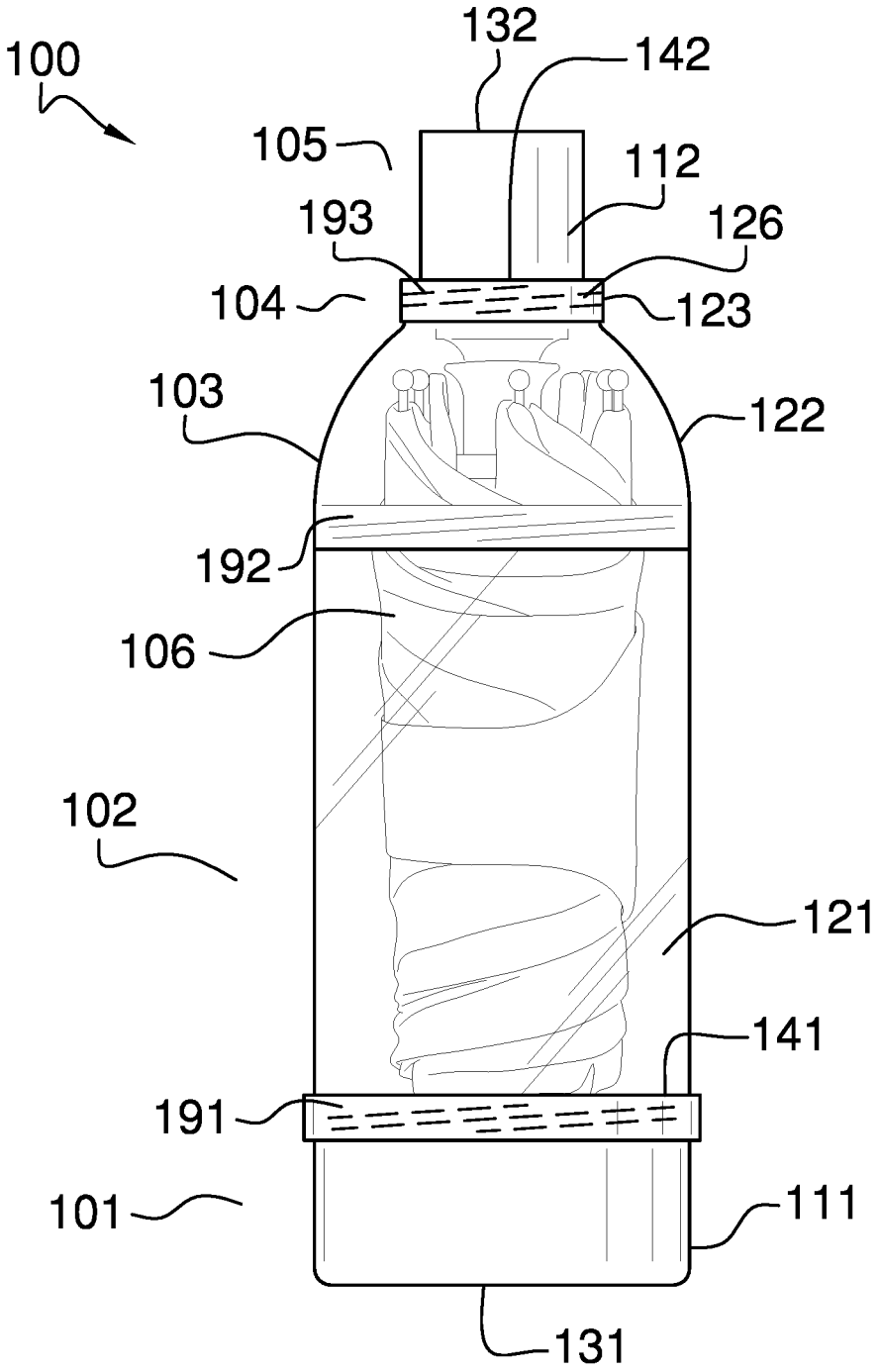
FIG. 1 is an in-use view of an embodiment of the disclosure.
Figure 2:
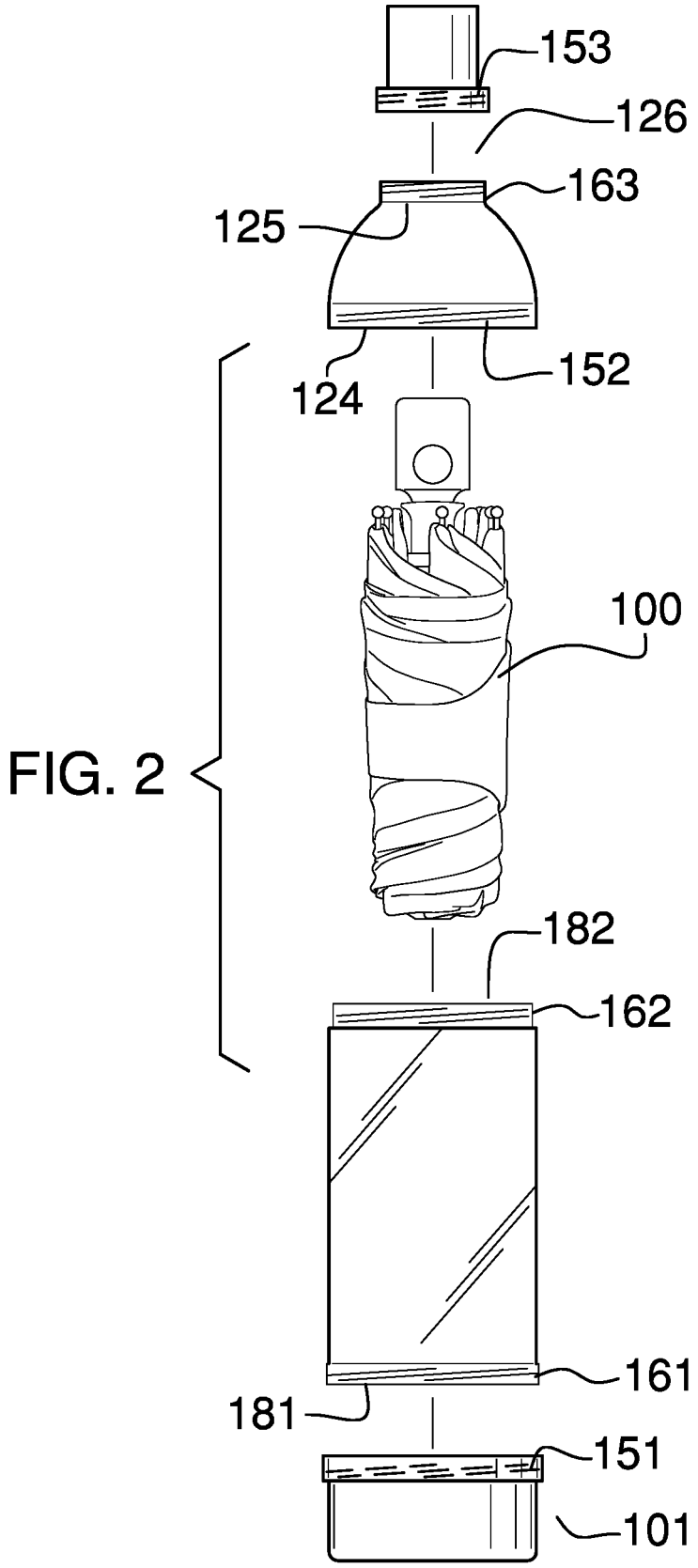
FIG. 2 is an exploded view of an embodiment of the disclosure.
Figure 3:
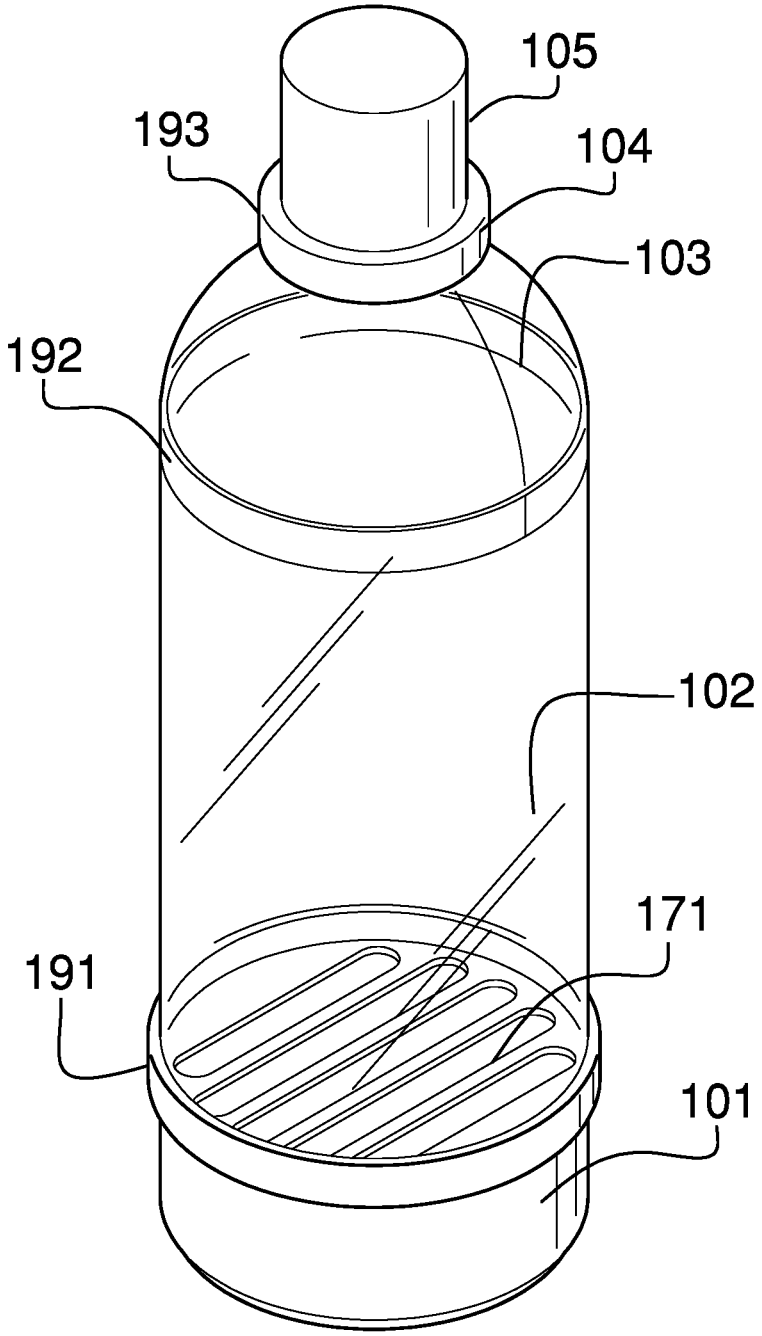
FIG. 3 is a perspective view of an embodiment of the disclosure.
Figure 4:
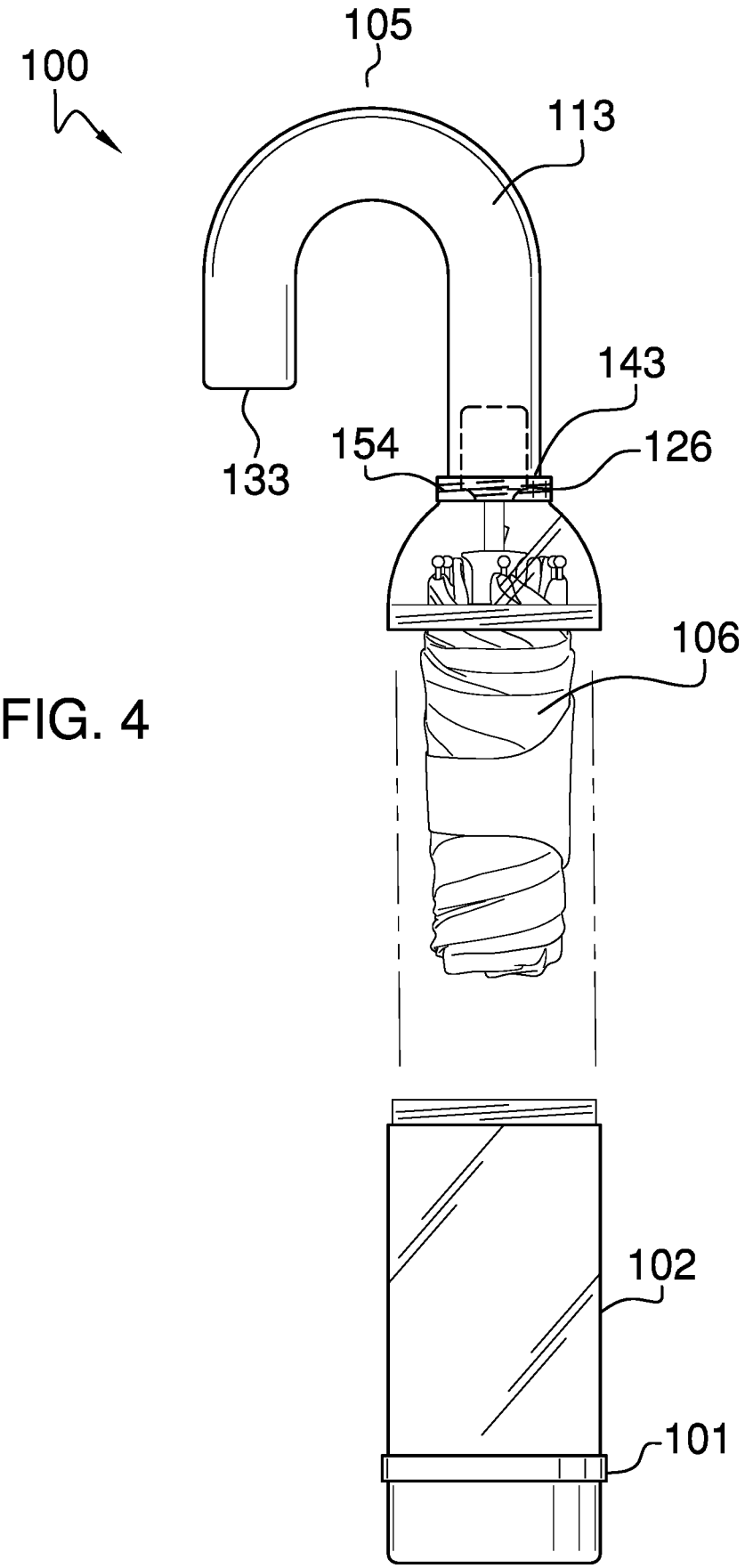
FIG. 4 is an exploded view of an alternate embodiment of the disclosure.

Detailed reference will now be made to one or more potential embodiments of the disclosure, which are illustrated in FIGS. 1 through 4.

The umbrella case 100 (hereinafter invention) is configured for use with an umbrella 106. The invention 100 is a container that is sized to receive the umbrella 106. The umbrella 106 is a portable canopy. The umbrella 106 is defined elsewhere in this disclosure. The invention 100 is a fluid impermeable structure. The invention 100 is a segregated structure. The invention 100 stores a wet umbrella 106 in a first segregated space such that any water adhering to the umbrella 106 drains off of the umbrella 106 into a second segregated space such that the water is separated from the umbrella 106. The invention 100 comprises a collection structure 101, a storage structure 102, a superior structure 103, a connecting ring 104, and a lid structure 105. The collection structure 101 removably attaches to the storage structure 102. The superior structure 103 removably attaches to the storage structure 102. The connecting ring 104 removably attaches the lid structure 105 to the superior structure 103.

The collection structure 101 is a hollow prism-shaped structure. The collection structure 101 has a capped tube structure. The collection structure 101 forms a containment structure that contains the water that drains from the umbrella 106. The collection structure 101 removably attaches to the storage structure 102 to form a composite prism structure. The collection structure 101 comprises a first capped tube 111, a first interior screw thread 151, and a grate structure 171.

The first capped tube 111 is a capped tube structure that forms the primary shape of the collection structure 101. The first capped tube 111 has a prism shape. The first capped tube 111 forms the physical structure that contains the water that drains off of the umbrella 106. The first capped tube 111 further comprises a first closed end 131 and a first open end 141. The first closed end 131 is the closed end of the capped tube structure of the first capped tube 111. The first open end 141 is the open end of the capped tube structure of the first capped tube 111.

The first interior screw thread 151 is an interior screw thread that is formed at the first open end 141 of the first capped tube 111.

The grate structure 171 is a disk-shaped structure. The grate structure 171 mounts in the first capped tube 111 of the collection structure 101. The grate structure 171 forms a supporting surface on which the canopy of the umbrella 106 rests. The grate structure 171 is a grated structure that allows water from the umbrella 106 to drain away from the umbrella 106 into the containment space of the collection structure 101.

The storage structure 102 is a hollow prism-shaped structure. The storage structure 102 has a tube structure. The storage structure 102 forms a containment structure that contains the canopy of the umbrella 106. The storage structure 102 removably attaches to the collection structure 101 and the superior structure 103 to form a composite prism structure. The storage structure 102 comprises a core tube 121, a first exterior screw thread 161, and a second exterior screw thread 162.

The core tube 121 has a prism structure. The core tube 121 has a tubular shape. The core tube 121 is sized such that the canopy of the umbrella 106 inserts into the hollow interior of the core tube 121. The core tube 121 further comprises a first congruent end 181 and a second congruent end 182. The first congruent end 181 is an open congruent end of the prism structure of the core tube 121. The second congruent end 182 is the open congruent end of the prism structure of the core tube 121 that is distal from the first congruent end 181.

The first exterior screw thread 161 is an exterior screw thread that is formed at the first congruent end 181 of the core tube 121. The second exterior screw thread 162 is an exterior screw thread that is formed at the second congruent end 182 of the core tube 121.

The superior structure 103 is a hollow semi-spherical structure. The superior structure 103 has a spherical section 122 structure. The superior structure 103 forms a containment structure that contains the handle of the umbrella 106. The superior structure 103 removably attaches to the storage structure 102 and the connecting ring 104 to form a composite prism structure. The superior structure 103 comprises a spherical section 122 and a second interior screw thread 152.

The spherical section 122 has a semispherical shape. The spherical section 122 is a hollow structure. The spherical section 122 has the shape of a spherical section 122. The spherical section 122 is defined elsewhere in this disclosure. The spherical section 122 further comprises a bifurcated base 124 and a truncated aperture 125. The second interior screw thread 152 is an interior screw thread that is formed at the bifurcated base 124 of the spherical section 122.

The bifurcated base 124 is the planar surface that bisects the sphere that forms the spherical section 122 into a semisphere. The bifurcated base 124 is an open face that provides access into the hollow interior of the spherical section 122. The truncated aperture 125 is a negative space formed through the exterior surface of the spherical section 122 that is parallel to the bifurcating plane that forms the spherical section 122. The truncated aperture 125 forms an aperture through the spherical section 122. The truncated aperture 125 is located on the spherical section 122 such that a line drawn from: a) the center of the sphere that forms the spherical section 122; and, b) the center of the negative space formed by the truncated aperture 125; is c) perpendicular to the bifurcated base 124 of the spherical section 122.

The connecting ring 104 is a ring structure. The connecting ring 104 has a disk-shaped structure. The connecting ring 104 is an intermediate structure that removably attaches the superior structure 103 to the lid structure 105. The connecting ring 104 attaches to the superior structure 103 and the lid structure 105 to form a composite prism structure. The connecting ring 104 comprises a ring disk 123.

The ring disk 123 is a prism-shaped structure. The ring disk 123 is a disk-shaped structure. The ring disk 123 has a ring structure. The ring disk 123 permanently attaches to the truncated aperture 125 of the spherical section 122. The ring disk 123 forms an intermediate structure that attaches the lid structure 105 to the superior structure 103. The ring disk 123 further comprises an inner aperture 126 and a third exterior screw thread 163.

The inner aperture 126 is a negative space formed through the congruent ends of the disk structure that forms the ring disk 123. The inner diameter of the inner aperture 126 is greater than or equal to the inner diameter of the truncated aperture 125. A line drawn from the center of the inner aperture 126 and the truncated aperture 125 will perpendicularly intersect with the bifurcated base 124. The third exterior screw thread 163 is an exterior screw thread that is formed on the exterior lateral face of the disk structure of the ring disk 123.

The lid structure 105 is a hollow prism-shaped structure. The lid structure 105 has a capped tube structure. The lid structure 105 completes the full enclosure of the umbrella 106 within the invention 100. The lid structure 105 removably attaches to the connecting ring 104 to form a composite prism structure with the connecting ring 104 and the superior structure 103. In the first potential embodiment of the disclosure, the lid structure 105 comprises a second capped tube 112 and a third interior screw thread 153.

The second capped tube 112 is a capped tube structure that forms the primary shape of the lid structure 105. The second capped tube 112 has a prism shape. The second capped tube 112 forms the physical structure that completes the full enclosure of the umbrella 106 within the invention 100. The second capped tube 112 further comprises a second closed end 132 and a second open end 142. The second closed end 132 is the closed end of the capped tube structure of the second capped tube 112. The second open end 142 is the open end of the capped tube structure of the second capped tube 112. The third interior screw thread 153 is an interior screw thread that is formed at the second open end 142 of the second capped tube 112.

This paragraph describes the assembly of the first potential embodiment of the disclosure. The first exterior screw thread 161 screws into the first interior screw thread 151 to form a first threaded connection 191 that removably attaches the collection structure 101 to the storage structure 102. The second exterior screw thread 162 screws into the second interior screw thread 152 to form a second threaded connection 192 that removably attaches the storage structure 102 to the superior structure 103. The third exterior screw thread 163 screws into the third interior screw thread 153 to form a third threaded connection 193 that removably attaches the superior structure 103 to the second capped tube 112 of the lid structure 105.

In a second potential embodiment of the disclosure, the lid structure 105 comprises a capped non-Euclidean tube 113 and a fourth interior screw thread 154.

The capped non-Euclidean tube 113 is a capped tube structure that forms the primary shape of the lid structure 105. The capped non-Euclidean tube 113 has a non-Euclidean prism shape. The capped non-Euclidean tube 113 forms the physical structure that completes the full enclosure of the umbrella 106 within the invention 100. The capped non-Euclidean tube 113 is further formed with an L-shaped curvature that allows the capped non-Euclidean tube 113 to be used as a handle. The capped non-Euclidean tube 113 further comprises a third closed end 133 and a third open end 143. The third closed end 133 is the closed end of the non-Euclidean capped tube structure of the capped non-Euclidean tube 113. The third open end 143 is the open end of the non-Euclidean capped tube structure of the capped non-Euclidean tube 113.

The fourth interior screw thread 154 is an interior screw thread that is formed at the third open end 143 of the capped non-Euclidean tube 113.

This paragraph describes the assembly of the second potential embodiment of the disclosure. The first exterior screw thread 161 screws into the first interior screw thread 151 to form a first threaded connection 191 that removably attaches the collection structure 101 to the storage structure 102. The second exterior screw thread 162 screws into the second interior screw thread 152 to form a second threaded connection 192 that removably attaches the storage structure 102 to the superior structure 103. The third exterior screw thread 163 screws into the fourth interior screw thread 154 to form a fourth threaded connection 194 that removably attaches the superior structure 103 to the capped non-Euclidean tube 113 of the lid structure 105.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cap: As used in this disclosure, a cap is a protective cover that encloses a space or opening.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure, a pyramid structure, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grate: As used in this disclosure, a grate is a mesh structure that vertically supports a solid object while allowing fluids to flow around the solid object.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Intermediate Structure: As used in this disclosure, an intermediate structure refers is an inert structure that attaches a first object to a second object.

Lid: As used in this disclosure, a lid is a removable cover that is placed over an opening of a hollow structure to enclose the hollow structure.

Negative Space: As used in this disclosure, negative space is a method of defining an object through the use of open or empty space as the definition of the object itself, or, through the use of open or empty space to describe the boundaries of an object.

Non-Euclidean Prism: As used in this disclosure, a non-Euclidean prism is a prism structure wherein the center axis of the prism lies on a non-Euclidean plane or is otherwise formed with a curvature.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Semisphere: As used in this disclosure, a semisphere is a structure formed in the shape of a half a sphere. Such a structure would be described as semispherical.

Sphere: As used in this disclosure, a sphere refers to a structure wherein every point of the surface of the structure is equidistant from a center point.

Spherical Section: As used in this disclosure, a spherical section refers to one of the two objects formed by the bifurcation of a sphere by a plane that does not pass through the center of the sphere. The major section is the spherical section that contains the larger volume. The minor section is the spherical section that contains the smaller volume. A spherical section is commonly called a spherical cap. The term spherical section is also applied to a semi-spherical structure.

Superior: As used in this disclosure, the term superior refers to a directional reference that is parallel to and in the opposite direction of the force of gravity when an object is positioned or used normally.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Umbrella: As used in this disclosure, an umbrella is a device used for protection against the weather comprising a (typically circular) canopy made of a textile or sheeting that is mounted on a folding metal frame that is supported by a central rod.

The following definition was used in this disclosure:

The following definitions and directional references were used in this disclosure:

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An umbrella case comprising a collection structure, a storage structure, a superior structure, a connecting ring, and a lid structure;

wherein the umbrella case is configured for use with an umbrella;

wherein the umbrella case is a container that is sized to receive the umbrella;

wherein the umbrella case is a fluid impermeable structure;

wherein the umbrella case stores the umbrella in a first segregated space such that any water adhering to the umbrella drains off of the umbrella into a second segregated space such that the water is separated from the umbrella;

wherein the collection structure removably attaches to the storage structure;

wherein the superior structure removably attaches to the storage structure;

wherein the connecting ring removably attaches the lid structure to the superior structure;

wherein the umbrella is further defined with a canopy;

wherein the collection structure has a capped tube structure;

wherein the collection structure contains the water that drains from the umbrella;

wherein the storage structure contains the canopy of the umbrella;

wherein the superior structure is a hollow semi-spherical structure;

wherein the superior structure contains a handle of the umbrella.

2. The umbrella case according to claim 1 wherein the connecting ring is an intermediate structure that removably attaches the superior structure to the lid structure.

3. The umbrella case according to claim 2 wherein the lid structure has a capped tube structure;

wherein the lid structure completes the full enclosure of the umbrella within the umbrella case;

wherein the lid structure removably attaches to the connecting ring.

4. The umbrella case according to claim 3 wherein the connecting ring permanently attaches to a truncated aperture of the hollow semi-spherical structure.

5. The umbrella case according to claim 4 wherein the collection structure comprises a first capped tube, a first interior screw thread, and a grate structure;

wherein the first interior screw thread is an interior screw thread that is formed at a first open end of the first capped tube;

wherein the grate structure mounts in the first capped tube of the collection structure.

6. The umbrella case according to claim 5 wherein the storage structure comprises a core tube, a first exterior screw thread, and a second exterior screw thread;

wherein the first exterior screw thread is an exterior screw thread that is formed at a first congruent end of the core tube;

wherein the second exterior screw thread is an exterior screw thread that is formed at a second congruent end of the core tube.

7. The umbrella case according to claim 6 wherein the superior structure comprises the hollow semi-spherical structure and a second interior screw thread;

wherein the second interior screw thread is an interior screw thread that is formed on the hollow semi-spherical structure.

8. The umbrella case according to claim 7 wherein the connecting ring further comprises an inner aperture and a third exterior screw thread;

wherein the inner aperture is a negative space formed through congruent ends of the connecting ring;

wherein the third exterior screw thread is an exterior screw thread that is formed on an exterior lateral face of the connecting ring.

9. The umbrella case according to claim 8 wherein the first capped tube forms the primary shape of the collection structure;

wherein the first capped tube contains the water that drains off of the umbrella;

wherein the first capped tube further comprises a first closed end and a first open end.

10. The umbrella case according to claim 9 wherein the grate structure is a disk-shaped structure;

wherein the grate structure forms a supporting surface on which the canopy of the umbrella rests.

11. The umbrella case according to claim 10 wherein the core tube further comprises a first congruent end and a second congruent end;

wherein the first congruent end is an open congruent end of the core tube;

wherein the second congruent end is distal from the first congruent end.

12. The umbrella case according to claim 11 wherein the lid structure comprises a second capped tube and a third interior screw thread;

wherein the second capped tube forms the primary shape of the lid structure;

wherein the second capped tube further comprises a second closed end and a second open end;

wherein the third interior screw thread is an interior screw thread that is formed at the second open end of the second capped tube.

13. The umbrella case according to claim 12 wherein the first exterior screw thread screws into the first interior screw thread to form a first threaded connection that removably attaches the collection structure to the storage structure;

wherein the second exterior screw thread screws into the second interior screw thread to form a second threaded connection that removably attaches the storage structure to the superior structure;

wherein the third exterior screw thread screws into the third interior screw thread to form a third threaded connection that removably attaches the superior structure to the second capped tube of the lid structure.

14. The umbrella case according to claim 11 wherein the lid structure comprises a capped tube and a fourth interior screw thread;

wherein the capped tube forms the primary shape of the lid structure;

wherein the capped tube forms the physical structure that completes the full enclosure of the umbrella within the umbrella case;

wherein the capped tube is further formed with a curvature that allows the capped tube to be used as a handle;

wherein the capped tube further comprises a third closed end and a third open end;

wherein the fourth interior screw thread is an interior screw thread that is formed at the third open end of the capped tube.

15. The umbrella case according to claim 14 wherein the first exterior screw thread screws into the first interior screw thread to form a first threaded connection that removably attaches the collection structure to the storage structure;

wherein the second exterior screw thread screws into the second interior screw thread to form a second threaded connection that removably attaches the storage structure to the superior structure;

wherein the third exterior screw thread screws into the fourth interior screw thread to form a fourth threaded connection that removably attaches the superior structure to the capped tube of the lid structure.

* * * * *